US006092850A

United States Patent [19]

Quigley

[11] Patent Number: 6,092,850

[45] **Date of Patent: *Jul. 25, 2000**

[54] ROLL LIFTING APPARATUS AND SYSTEM

[75] Inventor: John C. Quigley, Dracut, Mass.

[73] Assignee: Middlesex Paper Tube, Co., Lowell, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 09/126,473

[22] Filed: Jul. 30, 1998

[51] Int. Cl.[7] ..... B66C 1/16; B66C 1/66

[52] U.S. Cl. ..... 294/103.1; 294/81.2; 294/81.5

[58] Field of Search ..... 294/103.1, 67, 294/22, 104, 67.5, 116, 81.2, 81.5, 81.51, 81.54; 414/910, 911

[56] References Cited

U.S. PATENT DOCUMENTS

| | | | |
|---|---|---|---|
| 2,370,528 | 2/1945 | Fountaine | 294/104 |
| 2,647,007 | 7/1953 | Gmoser et al. | 294/104 |
| 2,782,067 | 2/1957 | Bonte et al. | 294/104 |
| 2,909,153 | 10/1959 | Mckinley et al. | 294/103.1 |
| 4,516,801 | 5/1985 | Burd | 294/67.1 |
| 4,563,031 | 1/1986 | Kishimoto et al. | 294/81.51 |
| 4,626,012 | 12/1986 | Weldele | 294/67.1 |
| 5,071,183 | 12/1991 | McDermott et al. | 294/81.5 |
| 5,445,426 | 8/1995 | Sorensen | 294/81.5 |

FOREIGN PATENT DOCUMENTS

| | | | |
|---|---|---|---|
| 0135182 | 4/1979 | Germany | 294/103.1 |
| 1310201 | 5/1987 | U.S.S.R. | 294/103.1 |

OTHER PUBLICATIONS

PCS–6P Six Ply Paper Creel Stand advertisement, PACO Winders Mfg. Inc., (No Date).

PCS–6P Six Play Paper Creel Stand with PCT–6P Six Ply Cascade Adhesive Tank advertisement, PACO Winders Mfg. Inc. (No Date).

Tilt–Lock advertisement, Tilt Lock Inc. (A Division of TC/American Monorail, Inc.). (No Date).

Yazoo Mills Catalog, Yazoo Mills Inc. (No Date).

Perkin Catalog, C. Perkin Ltd. (No Date).

*Primary Examiner*—Dean J. Kramer

*Assistant Examiner*—Paul T. Chin

*Attorney, Agent, or Firm*—Brian L. Michaelis, Esq.; David D. Lowry, Esq.; Brown Rudnick Freed & Gesmer, PC

[57] ABSTRACT

A lifting apparatus and system for lifting cylindrical rolls such as paper rolls is includes a horizontal beam with a gripping component at one end. A pivoting component is pivotally attached to the beam at another point. An engaging component is attached to the beam between the gripping component and the pivoting component and is located proximate the pivoting component. The pivoting component also includes an extension arm for connecting to a lifting mechanism such as a pulley or crane. The lifting apparatus is positioned over a horizontal roll so that the gripping component engages the roll in the center hole or hub. The engaging component grips the edge of the roll, and is securely held in place by the force of the pivoting component when lifting force is applied to the extension arm of the pivoting component. The lifting apparatus also allows easy maneuvering of a roll including mounting the roll in a horizontal or vertical position once the roll has been transported to the proper position.

19 Claims, 5 Drawing Sheets

ROLL LIFTING APPARATUS AND SYSTEM

FIELD OF INVENTION

This invention is directed towards grasping and lifting devices, and more specifically to an apparatus for lifting and maneuvering rolls of material, including paper rolls.

BACKGROUND OF THE INVENTION

Rolls of material are often used in industry for transporting and storing material. For example, wire or paper are stored in large rolls for convenience of use. The rolls can be quite large and difficult to lift, handle and maneuver. For example, paper rolls used in the packaging industry for making materials such as cardboard or paper tubes come in rolls of varying sizes. Such paper rolls can weigh up to 2000 pounds. The rolls are usually stacked flat for shipping and storage. For use, however, the rolls must be lifted and carried over to a machine for mounting and unwinding. Paper rolls are usually mounted upright, i.e., a mounting hole in the center of the roll must be inserted on a horizontal bar or bobbin.

Paper rolls presently are typically manually handled by workers. However, the size and weight of the rolls makes handling the rolls very difficult, cumbersome and dangerous. Injuries, including back strains, are common.

Systems for mechanical lifting and carrying of such rolls are known. One known method of lifting rolls includes an overhead crane with a center-gripping component for gripping the center hole on a horizontally stacked roll. The gripping component grasps the center hole using a frictional device and/or sharp prongs to frictionally engage the center of the roll. The crane can then lift the roll and transport it to the intended destination. To lift the roll onto a machine for horizontal mounting on a bar, the lifting device must turn the roll 90° upright to mount the roll onto the horizontal bar. Turning of the roll is difficult, and can require several workers to help turn and mount the roll. Since the roll is gripped at its center (i.e. at the center hole), the roll has a low center of gravity and tends to remain horizontal. Re-orienting the roll into an upright (vertical) position requires great strength to overcome the center of gravity.

Further, if the roll is loosely wrapped or insecure in any way, lifting the roll by the center is problematic since the material, such as paper, will unravel. Lifting a loosely wrapped roll at its center can result in "coning" wherein the center is lifted but the extremes of the roll do not lift, forming a cone rendering the roll effectively unusable. Known devices grip the roll solely by the center hole, thus mounting the roll onto its final destination is difficult because the center hole is effectively blocked by the lifting device.

SUMMARY OF THE INVENTION

The present invention provides a lifting device which reduces strain on workers, can handle heavy rolls and rolls which are not wound tightly thereby substantially preventing coning and which allows very easy maneuvering and mounting of the rolls once they are properly lifted.

According to the invention a roll lifting apparatus is configured for gripping a cylindrical object having a center hole, for example a roll of material. The roll-lifting apparatus comprises a gripping component, with a beam component rigidly coupled at substantially a right angle to the gripping component. A pivoting component including a first end and a second end which is pivotally coupled to the beam component at a point between the first and second ends.

An engaging component is slidingly coupled to the beam component at a location between the gripping component and the pivoting component, and proximate to the pivoting component. Pivotal rotation of the pivoting component causes the second end of the pivoting component to apply force to the engaging component in a direction along the beam component towards the gripping component. An object to be lifted is gripped between the gripping component and the engaging component.

The pivoting component includes an extension component rigidly coupled at a substantially right angle to the first end of the engaging component. The extension component may include a hole or eye for attachment to an automated lifting hook or cable.

The position of the gripping component and/or the pivoting component on the beam component may be independently adjusted. An elastic connector such as a spring maintains the engaging component next to the pivoting component while the apparatus is used.

Features of the present invention include provision of an apparatus for easy lifting and maneuvering of rolls of material, such as paper rolls. The roll is securely gripped and cannot unravel or come loose from the lifting apparatus. Further, the roll can be easily grasped and picked up from either a horizontal or vertical position. Similarly, the roll can easily be positioned and released in a horizontal or vertical position (or any angle in between), such as for mounting the roll onto a spindle or hub of a machine. The apparatus is easy to use by virtually anyone.

The present invention provides a lifting mechanism facilitating reliable lifting of rolls of virtually any shape or size. The positive mechanical action guarantees a secure connection even for very heavy rolls. The present invention can be quickly adapted to fit rolls of different sizes by simple adjustments to the position of the pivoting component and/or the gripping component. Further, the engaging component can be easily removed and replaced with a different size engaging component, for example one with a longer edge to grasp rolls of different width(s).

Yet another advantage is that the present invention is a mechanism which is simple and economical to manufacture and use. There are no complicated parts or tolerances to manufacture.

BRIEF DESCRIPTION OF THE DRAWINGS

The foregoing and other features and advantages of the present invention will be more fully understood from the following detailed description of illustrative embodiments, taken in conjunction with the accompanying drawings in which.

DETAILED DESCRIPTION

Figure 1:
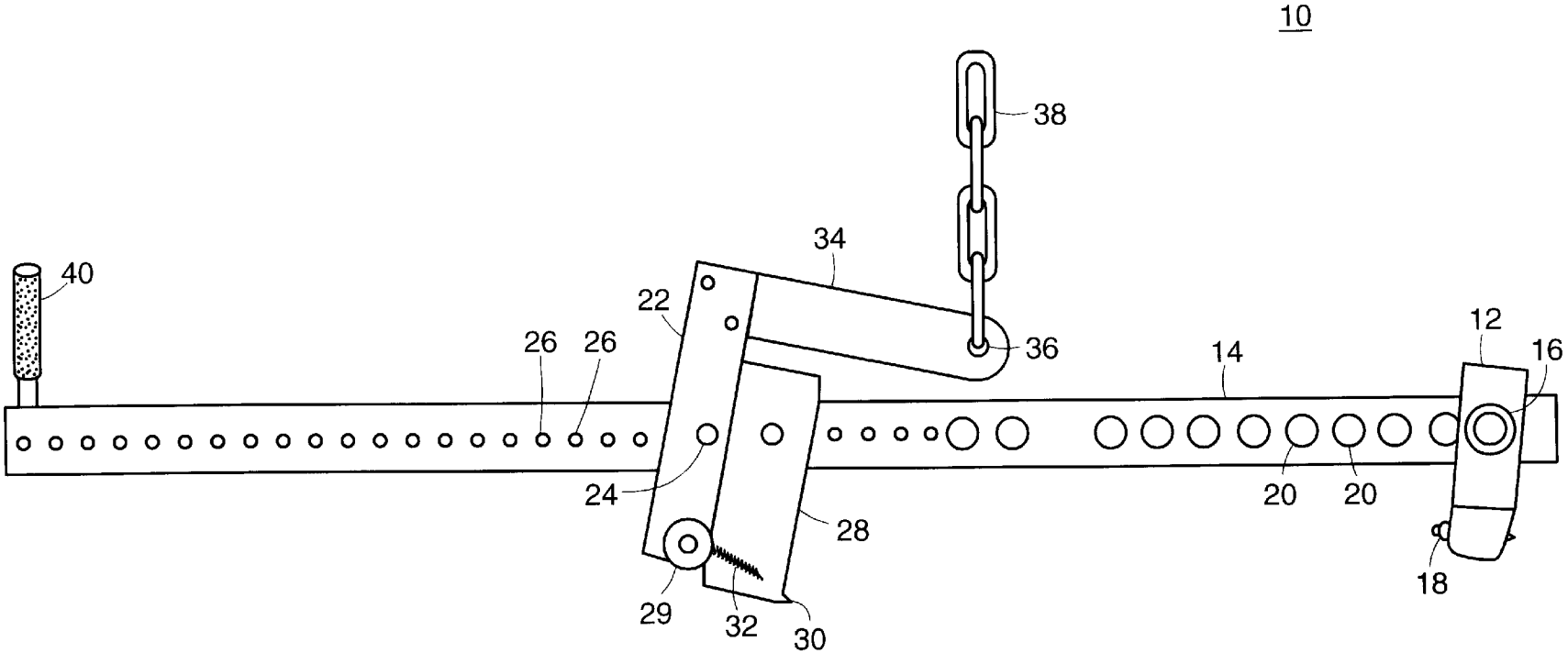
FIG. 1 illustrates a lifting apparatus according to the present invention.

An illustrative lifting apparatus 10 according to the present invention is shown in FIG. 1. The lifting apparatus 10 includes a gripping component 12 for gripping the center (e.g., the center hole) of the object to be lifted. The gripping component 12 is mounted on a beam 14. The gripping component 12 is mounted on the beam 14 using mechanical fasteners, such as a nut and bolt that are reconfigured in selected holes 20, so that the gripping component 12 can be adjusted to any position along the beam 14. In an alternative embodiment, the beam 14 could include fewer or greater holes and the gripping component 12 could include an attaching mechanism 16 other than a nut and a bolt, wherein the attaching mechanism 16 can be removed allowing the gripping component 12 to be positioned over any one of the holes 20 in the beam 14. Alternatively, the gripping component could be fixed, i.e. locked down. The gripping component 12 also optionally includes a protuberance 18 for securely gripping the inside surface of the center hole or hub of the object or roll being lifted. Other means for tightly and securely gripping the center hole include a frictional surface, air pressure/suction device, or a bottom lip which supports a bottom edge of the center hole.

Also mounted on the beam 14 is a pivoting component 22 which is mounted on the beam 14 around a pivot point 24. Similar to the gripping component 12, the pivoting component 22 can be slidably installed or securely locked in any position along the beam 14. For example, in the illustrative embodiment, the pivot component 22 uses the holes 26 in the beam 14 and a movable pivot point 24 with a removable bolt. Other pivoting points and mechanisms are possible, including quick-release devices to allow easy positioning of the pivoting component 22 along the beam 14.

The pivoting component 22 also includes an extension arm 34. The extension arm 34 is preferably mounted at substantially a right angle to the top of the pivoting component 22, and extends in the direction of the gripping component 12. The extension arm 34 includes a hole or eye 36 for connection to a lifting hook, chain or rope, e.g., chain 38.

Proximate to the pivoting component 22 is an engaging component 28. The engaging component 28 is mounted on the beam 14 in such a way that the engaging component 28 can slide freely on the beam 14. In the illustrative embodiment, the engaging component surrounds the beam 14 with a U-shaped design. The engaging component 28 also includes a bottom lift 30 for assisting and grasping the object or roll to be lifted. A friction bearing or roller 29 is disposed on the pivoting component 22 to minimize friction between the engaging component 28 and the pivoting component 22. Also in the illustrative embodiment, the engaging component 28 is coupled to the pivoting component 22 by an elastic connector such as a spring 32. This connector 32 serves to keep the engaging component 28 proximate to the pivoting component 22 as the pivoting component 22 pivots.

The lifting apparatus 10 may also optionally include a handle 40 mounted at any position along the beam 14, distal to the gripping component 12, to allow workers to easily maneuver the lifting apparatus 10 in use.

The lifting apparatus 10 is preferably constructed out of a strong rigid material such as aluminum or steel. The choice of materials depends upon the usage and type or rolls or other cylindrical objects being lifted by the lifting apparatus 10.

Figure 2:
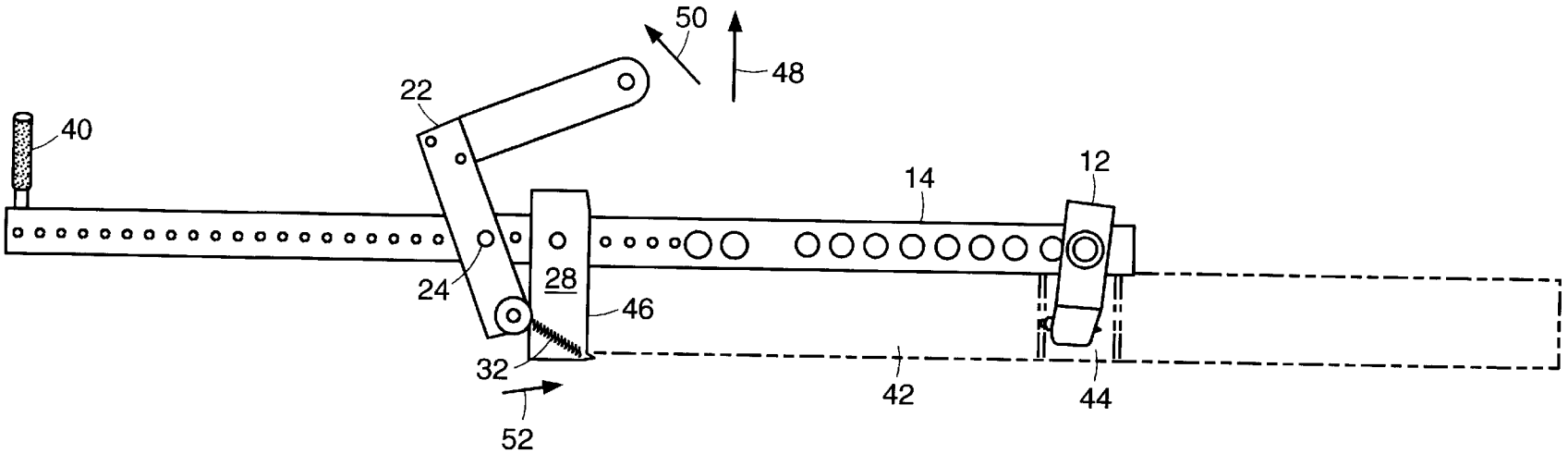
FIG. 2 shows details of the lifting apparatus shown in FIG. 1 while the lifting apparatus is gripping a roll.

The action performed by the lifting apparatus 10 according to the present invention is illustrated in FIG. 2. An object to be lifted, for example, a roll 42 (shown in phantom) includes a center hub or hole 44. In use, the lifting apparatus 10 is placed on the roll 42 so that the gripping component 12 engages the center hole 44 of the roll 42. Once the gripping component 12 is in position, the beam 14 can be positioned along the top of the roll 42 with the engaging component 28 proximate to the outer edge 46 of the roll 42. Upon applying an upward force on the pivoting component 22, as shown by arrow 48, the pivoting component 22 will pivot around the pivot point 24 thereby applying force to engaging component 28 to tightly compress and securely grip the roll 42. The pivoting component 22 applies a secure force to the back edge of the engaging component 28 to securely grip the roll 42 with a force in the direction as shown by arrow 52.

Figure 3:
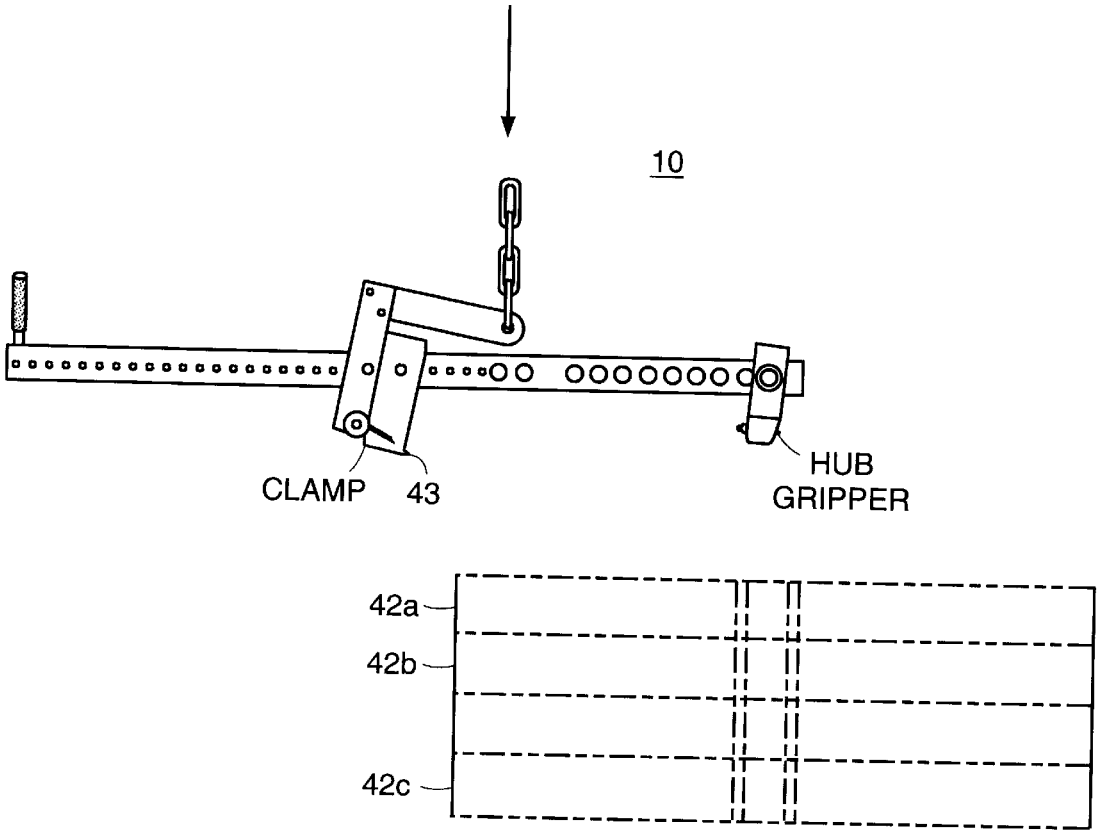
FIG. 3 shows the lifting apparatus of the present invention in use lifting a roll.

When the pivoting component 22 is in the lowered (open) position (as illustrated in FIG. 3), the spring 32 applies force to the engaging component 28 to slide the engaging component 28 toward the pivoting component 22 to help clear the edge of the roll 42 (not shown). When a roll 42 is gripped as shown in FIG. 2, the engaging component 28 will slide to a proper gripping position. This operation requires minimal assistance from a worker, other than positioning the lifting apparatus 10 onto the roll 42.

The pivoting component 22 maintains a secure grip on the engaging component 28 and the roll 42 even if the lifting force applied to engaging component 28 is not in an absolute vertical direction (e.g., as shown by arrow 50 in FIG. 2).

Figure 4:
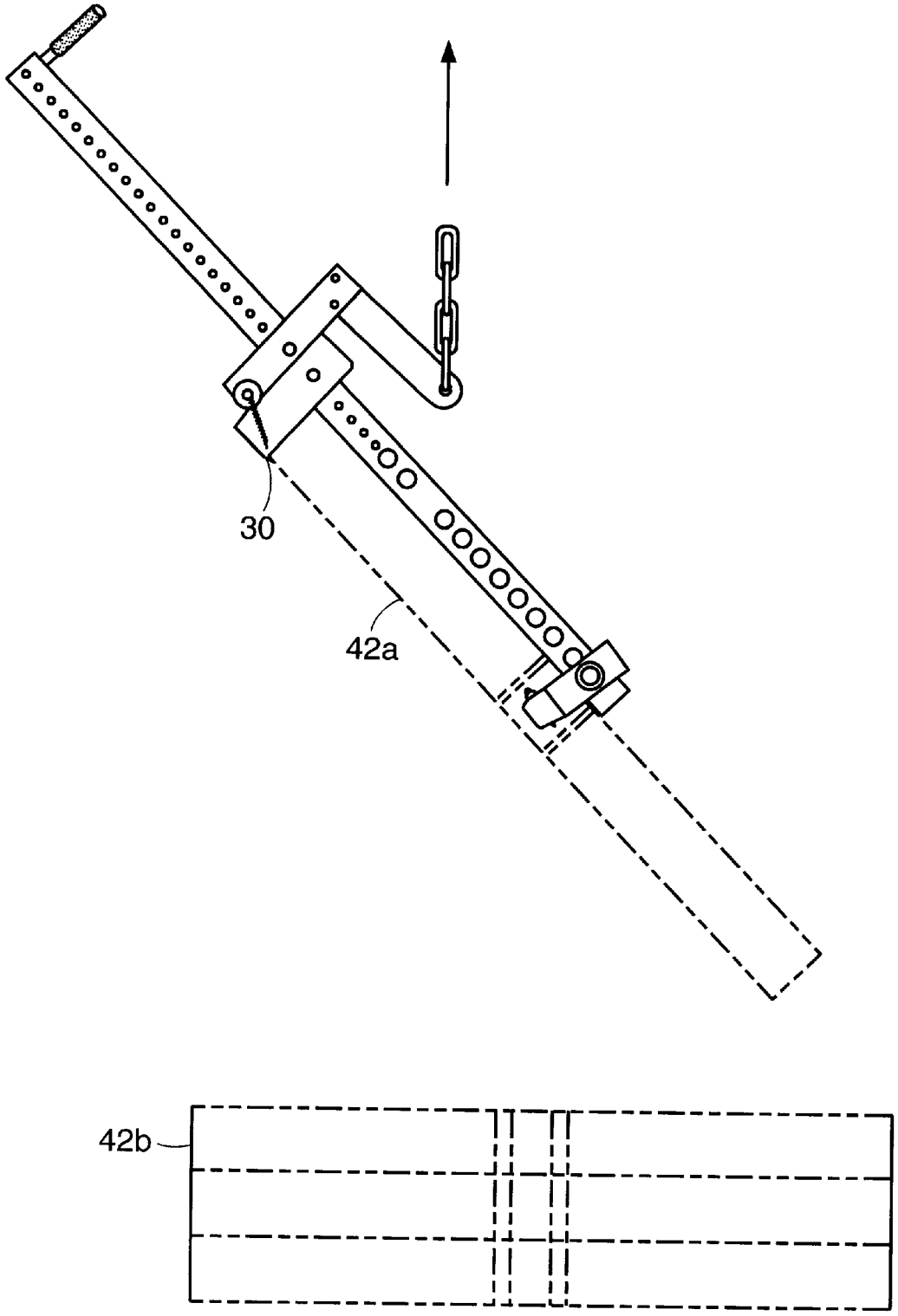
FIG. 4 is a continuation of FIG. 3 showing the lifting apparatus of the present invention lifting a roll.

Referring now to FIG. 3, in operation the lifting apparatus 10 is positioned over a stack of rolls 42*a–c*. The lifting apparatus 10 is lowered onto the top roll 42*a*, so that the gripping component 12 is inserted in the center hole of the roll and the bottom lift 30 of the engaging component 28 engages a bottom edge of the roll. Once in position, an upward force from a lifting mechanism such as a hoist, block and tackle, crane or the like (not shown) will lift the top roll 42*a* as shown in FIG. 4. Because of the center of gravity of the combination of the lifting apparatus 10 and the roll 42*a*, the lifting apparatus will normally assume a titled angle as the roll 42*a* is lifted. A secure grip will be maintained on the roll 42*a* no matter what the angle which the lifting apparatus 10 and the roll 42*a* assume. Further, the lifting apparatus 10 allows the roll 42*a* to be easily maneuvered by a worker at any of various angles. Very little force is needed to push the roll 42*a* into a vertical position for example to mount the roll 42*a* onto a machine, or to place the roll 42*a* vertically on a floor. Alternatively, if the roll 42*a* is to be positioned horizontally, the lifting apparatus 10 and roll 42*a* also easily accommodate that angle with little force. For mounting the roll 42*a* in a vertical position, a worker simply needs to rotate the paper roll into a vertical position and slide the roll 42*a* partially onto the mounting cylinder, whereupon the lifting mechanism can release lifting force on the lifting apparatus 10 allowing the engaging component 28 to release the edge of roll 42*a* and the entire lifting apparatus 10 to disengage. The worker can then slide the roll 42*a* completely onto the mounting spindle.

Figure 5:
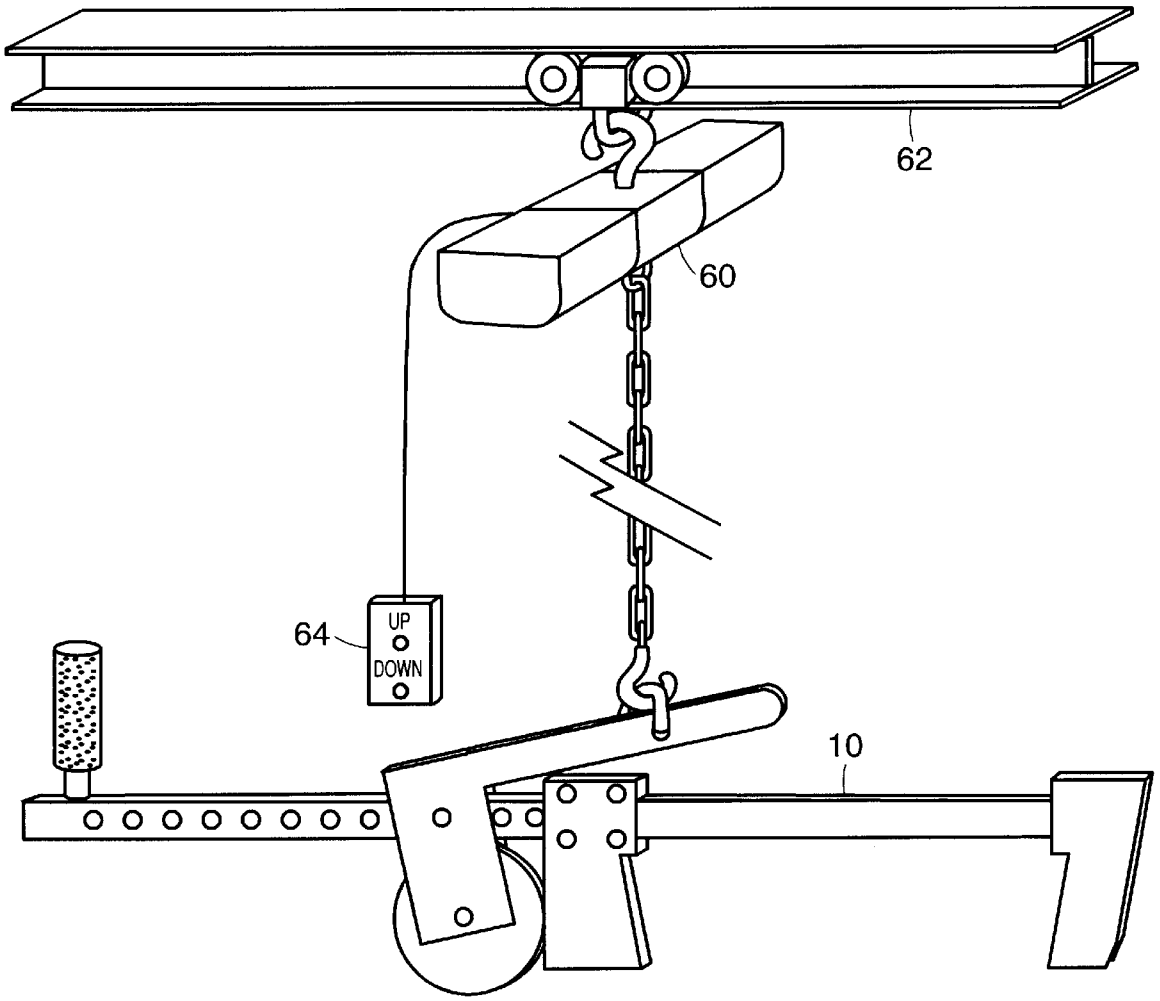
FIG. 5 is an illustration of a lift system incorporating the lifting apparatus of FIG. 1.

As illustrated in FIG. 5, the lifting apparatus 10 can be attached to an automated lift, such as an automated chain hoist 60, that is engaged on a track or beam 62 such as can be attached to the ceiling structure in a plant. The track or beam 62 can be an I-beam structure along which the chain hoist is conveyed via wheels. Accordingly, the lifting apparatus is incorporated in a lift system and can be used to transport objects, such as paper rolls, over distances in the plant. The chain hoist system, as known in the art, includes controls 64 that are used to automatically raise and lower a roll engaged in the lifting apparatus as described hereinbefore. The track and wheel system that the chain hoist and lifting apparatus is attached to allows a worker to easily convey a very heavy and large roll around a plant very simply and easily (in fact in many cases using only one hand).

Although described in terms of rolls such as paper rolls, the present invention can be used to lift any of various objects, including cylindrically wound or wrapped structures such as wire, tubing, lashing or the like where a simple and automatic 2-point compression-gripping component is needed.

It should be appreciated that other components can be added to the simple lift mechanism according to the invention, such as a toggle lock added between the pivoting component and engaging component to maintain and/or increase compression of an engaging component against an engaged roll.

It should be appreciated that the gripping component, engaging component and beam can be appropriately dimensioned as a function of the size, or range of sizes, of rolls or objects to be lifted.

It should be appreciated that the beam can have holes along its entire length to facilitate placement of the pivoting component and to reduce weight of the device, or holes can be strategically placed as a function of the desired placement of the pivoting and/or gripping component.

Although the invention has been shown and described with respect to illustrative embodiments thereof, it should be understood by those skilled in the art that the foregoing and various changes, omissions and additions in the form and detail thereof may be made without departing from the spirit and scope of the invention as delineated in the claims.

What is claimed is:

1. A gripping apparatus for gripping a cylindrical object including a center hole, comprising:

a gripping component;

a beam component rigidly coupled to said gripping component;

a pivoting component including a first and second end, said pivoting component pivotally coupled to said beam component at a point between said first and second end and including an extension arm rigidly coupled to said first end of said pivoting component, said extension arm being configured for lifting said gripping apparatus; and an engaging component, slidingly coupled to said beam component between said gripping component and said pivoting component, and proximate said pivoting component, wherein pivotal rotation of said pivoting component causing said second end of said pivoting component to apply force to said engaging component in a direction along said beam component towards said gripping component.

2. The apparatus of claim 1 wherein said pivoting component includes an extension component rigidly coupled at a substantially right angle to said first end of said pivoting component.

3. The apparatus of claim 1 wherein said cylindrical object is a roll of material.

4. The apparatus of claim 3 wherein said roll of material is a paper roll.

5. The apparatus of claim 1 wherein position where said pivoting component is coupled to said beam component is adjustable to different positions along said beam component.

6. The apparatus of claim 1 wherein position where said gripping component is coupled to said beam component is adjustable to different positions along said beam component.

7. The apparatus of claim 1 wherein said engaging component is elastically coupled to said pivoting component.

8. The apparatus of claim 1 wherein said gripping component includes prongs for gripping said center hole of said cylindrical object.

9. The apparatus of claim 1 wherein said engaging component includes a bottom lip for engaging an edge of said cylindrical object.

10. An apparatus for gripping a paper roll comprising:

a gripping component including prongs;

a beam component detachably rigidly coupled to said gripping component;

a pivoting component including a first and second end, said pivoting component detachably pivotally coupled to said beam component at a point between said first and second end, and including an extension component rigidly coupled at a substantially right angle to said first end of said pivoting component;

an engaging component, slidingly coupled to said beam component between said gripping component and said pivoting component, and elastically coupled to said pivoting component, wherein pivotal rotation of said pivoting component causes said first end of said pivoting component to apply force to said engaging component in a direction along said beam component towards said gripping component.

11. The apparatus of claim 10 wherein said engaging component includes a bottom lip for engaging an edge of said paper roll.

12. The apparatus of claim 10 wherein a handle is attached to said beam component distal to said gripping component.

13. A lift system, comprising:

a track;

a lift mechanism movable along said track;

a gripping apparatus including a gripping component;

a beam component rigidly coupled to said gripping component;

a pivoting component including a first and second end, said pivoting component pivotally coupled to said beam component at a point between said first and second end and including an extension component rigidly coupled to said first end of said pivoting component, said extension component being configured for lifting said gripping apparatus; and an engaging component, slidingly coupled to said beam component between said gripping component and said pivoting component, and proximate said pivoting component, wherein pivotal rotation of said pivoting component causing said second end of said pivoting component to apply force to said engaging component in a direction along said beam component towards said gripping component.

14. The lift system of claim 13 wherein said track is comprised of at least one I-beam.

15. The lift system of claim 13 wherein said lift mechanism is a chain hoist.

16. The lift system of claim 13 wherein said pivoting component includes an extension component rigidly coupled at a substantially right angle to said first end of said pivoting component.

17. The lift system of claim 13 wherein position where said pivoting component is coupled to said beam component is adjustable to different positions along said beam component.

18. The lift system of claim 13 wherein position where said gripping component is coupled to said beam component is adjustable to different positions along said beam component.

19. The lift system of claim 13 wherein a handle is attached to said beam component distal to said gripping component.

* * * * *